US008133007B2

(12) United States Patent
Marcelli

(10) Patent No.: US 8,133,007 B2
(45) Date of Patent: Mar. 13, 2012

(54) MULTIPLE-STAGE CENTRIFUGAL PUMP INCLUDING A CONTROLLED LEAKAGE HYDRAULIC BALANCING DRUM

(75) Inventor: Alberto Marcelli, Acqui Terme Alessandria (IT)

(73) Assignee: Pompe Garbarino S.p.A., Acqui Terme Alessandria (IT)

( * ) Notice: Subject to any disclaimer, the term of this patent is extended or adjusted under 35 U.S.C. 154(b) by 481 days.

(21) Appl. No.: 12/454,204

(22) Filed: May 14, 2009

(65) Prior Publication Data

US 2010/0068031 A1 Mar. 18, 2010

(30) Foreign Application Priority Data

Sep. 15, 2008 (IT) ..... MI2008A1639

(51) Int. Cl.
*F01D 3/00* (2006.01)

(52) U.S. Cl. ..... 415/104; 417/365

(58) Field of Classification Search ..... 415/104–107; 417/365

See application file for complete search history.

(56) References Cited

U.S. PATENT DOCUMENTS

| | | | | | |
|---|---|---|---|---|---|
| 3,746,461 | A * | 7/1973 | Yokota et al. | ..... | 415/104 |
| 4,493,610 | A * | 1/1985 | Iino et al. | ..... | 415/104 |
| 4,538,960 | A * | 9/1985 | Iino et al. | ..... | 415/104 |
| 5,591,016 | A * | 1/1997 | Kubota et al. | ..... | 417/365 |
| 5,713,720 | A * | 2/1998 | Barhoum | ..... | 415/104 |
| 6,135,728 | A * | 10/2000 | Klein et al. | ..... | 417/420 |
| 6,193,462 | B1 * | 2/2001 | Kubota | ..... | 415/106 |
| 6,264,440 | B1 * | 7/2001 | Klein et al. | ..... | 417/420 |
| 6,506,031 | B2 * | 1/2003 | Sishtla | ..... | 417/366 |
| 6,568,901 | B2 * | 5/2003 | Wang et al. | ..... | 415/104 |
| 7,686,572 | B2 * | 3/2010 | Wahl et al. | ..... | 415/26 |
| 8,016,545 | B2 * | 9/2011 | Oklejas, Jr. | ..... | 415/106 |
| 2002/0146332 | A1 * | 10/2002 | Sishtla | ..... | 417/366 |
| 2007/0140834 | A1 * | 6/2007 | Choi et al. | ..... | 415/104 |
| 2009/0074560 | A1 * | 3/2009 | Madison | ..... | 415/106 |
| 2010/0068031 | A1 * | 3/2010 | Marcelli | ..... | 415/104 |

* cited by examiner

*Primary Examiner* — Ross Gushi

(74) *Attorney, Agent, or Firm* — Hedman & Costigan, P.C.; James V. Costigan

(57) ABSTRACT

A multiple-stage centrifugal pump comprises a balancing drum coupled to the pump shaft, being axially locked, and turning in a pump body cavity with a minimum clearance; a rotary ring element mounted on the balancing drum and rotating therewith, but being able of axially moving with respect to the rotary shaft, and a fixed ring element mounted on the bottom of the body, a face of the rotary ring element having an annular surface and forming with the fixed ring element a radial breakage path therethrough the fluid flows, the outer diameter of the drum and rotary ring element forming an annular surface providing an axial pushing force, the outer diameter of the rotary ring element, forming a narrowed portion, being less than the diameter of the balancing drum, a pressure difference operating on these surfaces providing a contactless leakage between the rotary ring and fixed ring elements, the axial position of the rotary ring element depending on a combined action of two pushing forces, thereby providing a very stable operation of the pump, the rotary ring element participating in applying the balancing force of the pump rotor thereby limiting the leakage flow loss.

8 Claims, 2 Drawing Sheets

MULTIPLE-STAGE CENTRIFUGAL PUMP INCLUDING A CONTROLLED LEAKAGE HYDRAULIC BALANCING DRUM

BACKGROUND OF THE INVENTION

The present invention relates to a multiple-stage centrifugal pump including a controlled leakage hydraulic balancing drum.

As is known, centrifugal pumps are susceptible to generate, in their operation, depending on their impeller being either hydraulically balanced or not, a reactive axial force between the rotary shaft/impeller portion and the fixed body/support/bearing portion.

In multi-stage centrifugal pumps, including several series-arranged pump impellers, said axial reactive force can achieve high values and, since it would be undesirable to directly transmit this force exclusively to the pump shaft support, different types of balancing devices therefor have been designed, which balancing devices, in particular, comprise balancing disc and balancing drum devices.

In a balancing disc/counter disc system, the axial load is transmitted to a disc coupled to the rotary shaft which can be freely axially driven with respect to the pump body and supports.

At the end of the pump body, on the pushing side thereof, is assembled a fixed disc element which, together with the rotary disc element assembled on the pump shaft, provides a radial leakage path therethrough the pump fluid flows.

In operation, a contactless narrowing, based on the pressure difference between the disc inner side and outer side, is formed, thereby transmitting the axial load under constant flow-rate/pressure head operating conditions. However, the designing of this balancing system is very difficult, in particular for variable pressure heads and flowrates.

In the balancing drum system, on the other hand, the axial load is transmitted to a balancing drum coupled to the pump shaft rotating in a static bush arrangement in the pump body cavity with a minimum radial clearance.

The pressure difference between the drum inner portion and outer portion is such as to balance the pump rotor, the residual load being absorbed by a thrust bearing axially locking the rotary portion.

The radial clearance between the balancing drum and bushing arrangement, which however cannot be lowered under a set minimum value, greatly affects the axial leakage, with a loss of a part of the pump flowrate, and a consequent reduction of the pump efficiency.

SUMMARY OF THE INVENTION

Accordingly, the aim of the present invention is to provide a multiple-stage centrifugal pump including a drum balancing device for eliminating unstable operations of the pump and reducing to a minimum the axial reactive force.

Within the scope of the above mentioned aim, a main object of the invention is to provide such a leakage system allowing to control and limit any pump flowrate losses, thereby providing an improved efficiency pump.

Yet another object of the present invention is to provide such a centrifugal pump including a balancing system providing a constant load on the pump bearings even in different flow-rate operation conditions.

Yet another object of the present invention is to provide such a centrifugal pump which, owing to its specifically designed constructional features, is very reliable and sage in operation.

According to one aspect of the present invention, the above mentioned aim and objects, as well as yet other objects, which will become more apparent hereinafter, are achieved by a multiple-stage centrifugal pump comprising:

a balancing drum coupled to the pump shaft and being axially locked, said balancing drum turning in a bushing arrangement or in a cavity of the pump body with a minimum radial clearance;

a rotary ring element mounted on said balancing drum and turning rigidly therewith, while being adapted to be axially displaced with respect to said balancing drum;

a fixed ring element mounted on the bottom of the pump body.

A face of the rotary ring element forms with the fixed ring element a radial leakage path therethrough the pumped fluid flows.

A cylindric portion of the balancing drum and the rotary ring element form an annular surface providing an axially reactive or pushing force.

The outer diameter of a narrowed portion formed by the rotary and fixed ring elements is less than that of the balancing drum and forms an annular surface.

The pressure difference operating on these two annular surfaces provides a contactless narrowing relationship between the rotary and fixed ring elements.

Since the axial position of the rotary ring element depends on a combined action of the above two mentioned pushing forces, the pump will operate in a very stable mode of operation.

According to the present invention, the balancing device is based on a combined action of the hydraulic pushing force, through the balancing drum axial leakage, and of the flow loss control, through the controlled leakage from the rotary ring element.

The balancing device according to the present invention comprises a mechanism with a mechanical type of sealing arrangement, but designed for preventing any physical contacts between the rotary and fixed ring element surfaces, to provide a permanently open leakage space, which does not provide a perfect sealing.

With respect to a prior mechanical sealing, the special effect provided by the present invention is that the rotary ring element assumes a stable equilibrium position under several operation conditions, thereby limiting any leakage losses.

The overall cross-section of the rotary ring element arranged in the pump body depends on the difference of the pressures providing the balancing force, the resultant force operating on the rotary ring element being offset through the narrowing part of the ring element annular surface, thereby providing the desired balancing effect.

The outer diameter of the leakage controlling rotary ring element annular surface is smaller than the outer diameter of the balancing drum, thereby the size of the annular leakage surface may be reliably defined according to the pump operation conditions.

BRIEF DESCRIPTION OF THE DRAWINGS

Further characteristics and advantages of the present invention will become more apparent hereinafter from the following detailed disclosure of a preferred, though not exclusive, embodiment of the invention, which is illustrated, by way of an indicative, but not limitative example, in the accompanying drawings, where.

DESCRIPTION OF THE PREFERRED EMBODIMENTS

Figure 1:
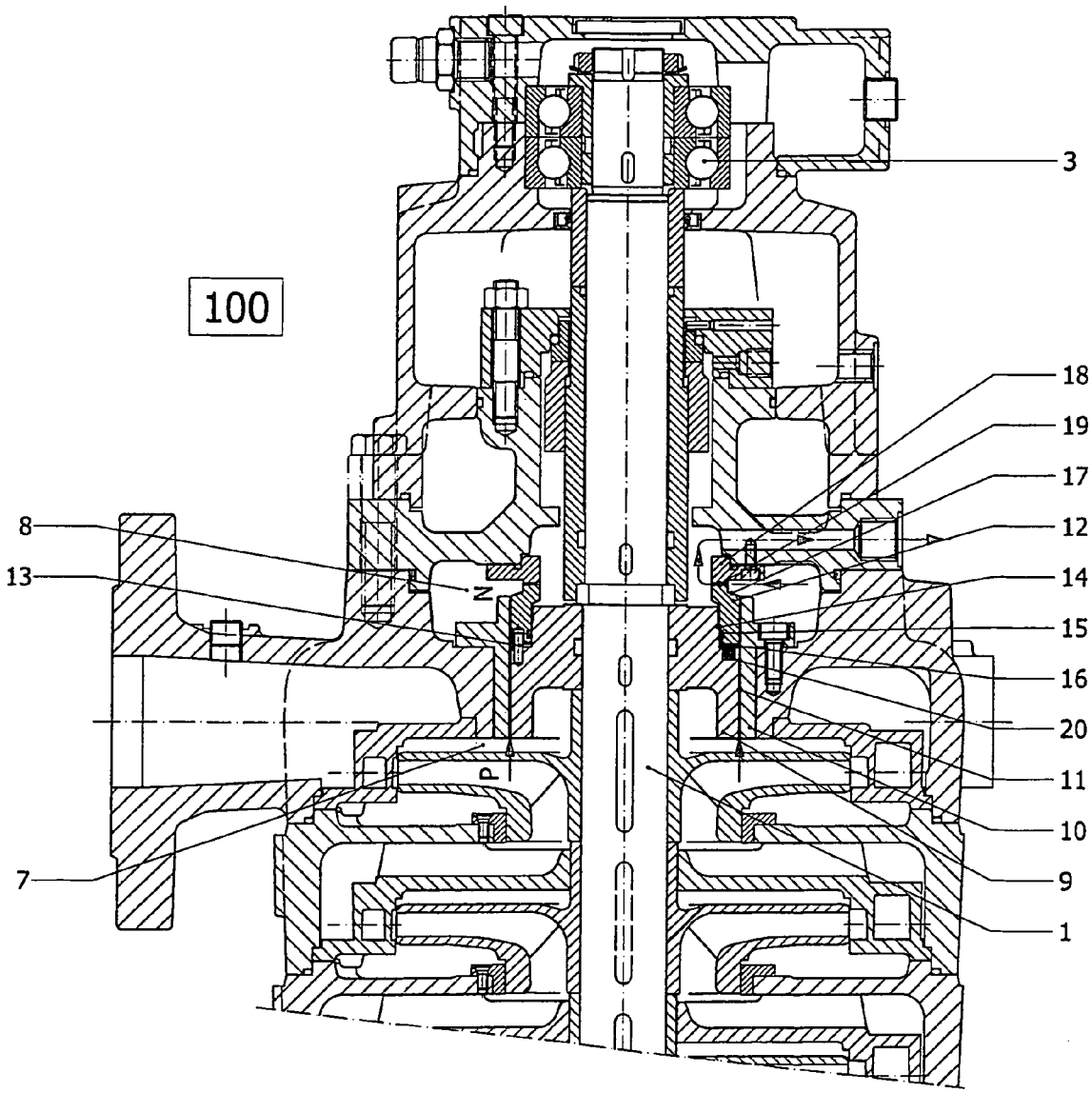
FIG. 1 shows a cross sectional view of a pump thereon a controlled leakage balancing device according to the present invention is assembled.
Figure 2:
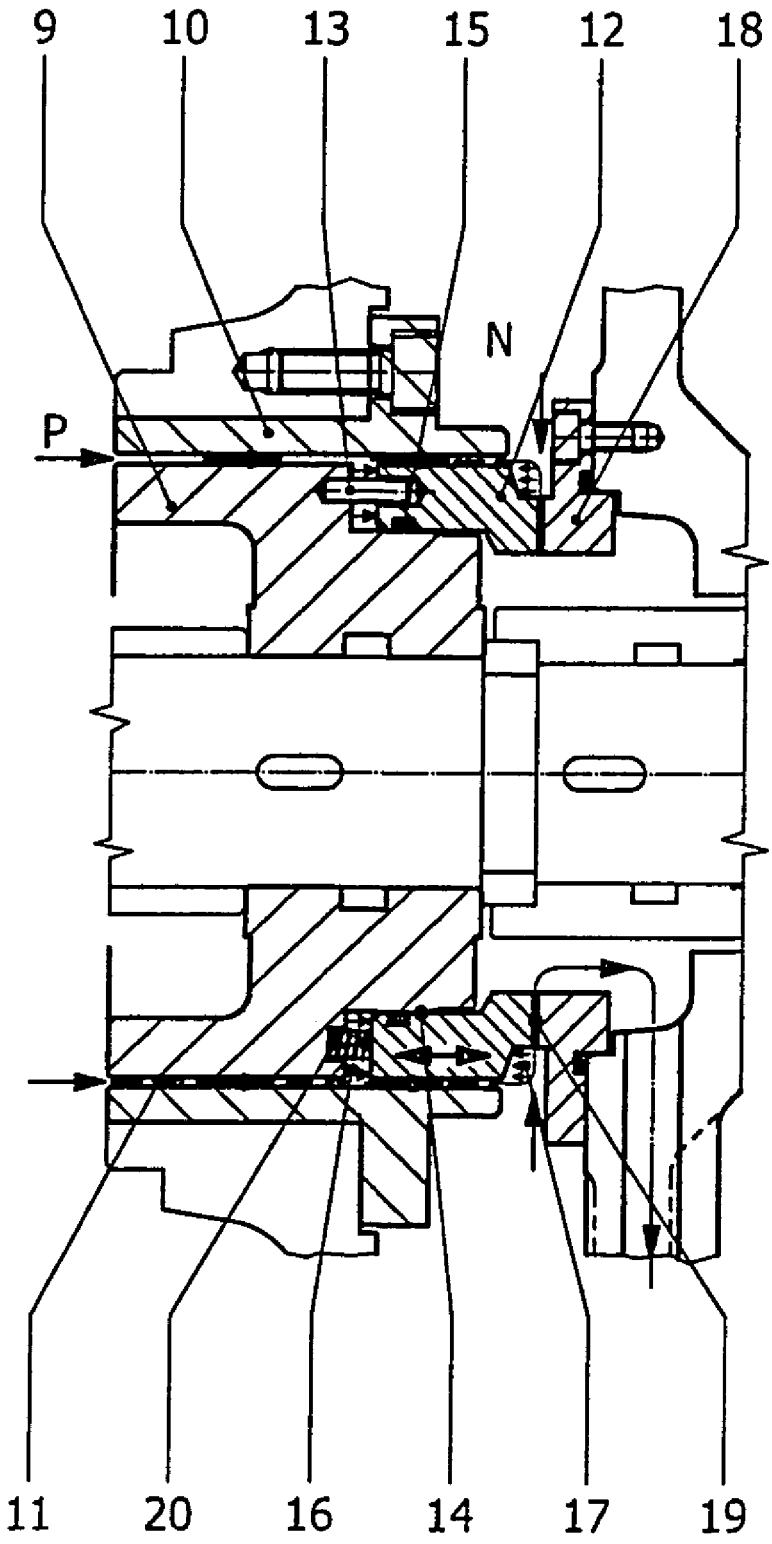
FIG. 2 is a cross-sectional view of the rotary ring element.

With reference to the number references of the above mentioned figures, the multiple-stage centrifugal pump including a balancing drum according to the present invention, which has been generally indicated by the reference number 100, comprises a balancing drum 9, coupled to the pump shaft 1, and a fixed portion including a bush arrangement 10 forming an axial cylindric leakage path 11, with a minimum radial clearance, and being arranged between the rear chamber 7, affected by the pump delivery pressure P, and the further chamber 8 where a smaller pressure N is present.

At the end portion of the balancing drum is provided a rotary ring element 12 having an outer diameter either equal to or different (depending on the designing parameters) from the outer diameter of the balancing drum, and rotating therewith as entrained by an entrainment or driving pin element 13 or any other suitable driving devices.

A cylindric portion 14 operates as a guide for the ring element on the balancing drum.

The clearance between the two mentioned parts is so designed as to allow the rotary ring element to axially move on the balancing drum under any operating conditions, whereas a gasket 15 provides a sealing coupling between the two parts.

The end portion of the rotary ring element arranged in front of the balancing drum is formed with an annular surface 16, whereas the opposite end portion of the ring element forms an annular surface 17.

A fixed ring element 18 is mounted on the bottom of the chamber 8 and forms, with said rotary ring element, a radial leakage path 19, therethrough a fluid flow is inward directed.

A series of spring elements 20 press the rotary ring element against the fixed ring element.

The outer diameter of the balancing drum is so set that the deferential pressure operation will produce the target balancing force.

More specifically, the leakage and related flow loss is reduced to minimum and controllable values.

The combined pushing force between the annular surfaces 16 and 17, will determine the equilibrium position of the rotary ring element, thereby providing a well stabilized radial leakage 19.

Since the flow loss value is determined by the pushing action of the annular surface 16, opposite to the annular surface 17, the designer will have a great freedom in designing the above surfaces; in particular, he may fit the designing operations depending on the pump operating conditions.

It has been found that the invention fully achieves the intended aim and objects.

If fact the invention allows to control the leakage losses in the balancing drum region, thereby reducing said losses by 90% with respect to a conventional balancing drum leakage, greatly increasing the overall pump efficiency, and providing a very reliable pump operation.

In practicing the invention, the used materials, as well as the contingent size and shapes, can be any, depending on requirements.

The invention claimed is:

1. A multiple-stage centrifugal pump including a controlled leakage hydraulic balancing drum, characterized in that said pump comprises an axially restrained pump shaft, a balancing drum coupled on said shaft and turning with a minimum radial clearance in a pump body or in a bush arrangement fixedly mounted on said pump body, and a rotary ring element mounted on said balancing drum, rotatively driven therewith, to axially move between said balancing drum and a fixed ring element mounted on said pump body, said rotary ring element having an end portion forming with said fixed ring element a narrowing portion therethrough a leakage flow passes, said balancing drum having a diameter controlling an axial balancing force of a rotor of said pump, said rotary ring being so hydraulically balanced as to define a set leakage loss.

2. A multiple-stage centrifugal pump, according to claim 1, characterized in that said balancing force is provided by a leakage provided by an axial movement of said rotary ring element, said rotary ring element assuming an axial position determined by a balancing of the pressures on annular surfaces of said rotary and fixed ring elements and by secondary forces, said narrowing portion and rotary ring element having an outer diameter smaller than an outer diameter of said balancing drum narrowing portion.

3. A multiple-stage centrifugal pump, according to claim 1, characterized in that said bush arrangement cooperates with said balancing drum through a minimum clearance narrowing portion arranged between a pump rear chamber in which a pressure P of said pump is present and a further chamber where a smaller pressure N is present.

4. A multiple-stage centrifugal pump, according to claim 1, characterized in that said rotary ring element is arranged at an end portion of said balancing drum, and has an outer diameter equal to or different from the outer diameter of said balancing drum and turning therewith rotatively entrained by a pin element.

5. A multiple-stage centrifugal pump, according to claim 1, characterized in that a said pump includes a cylindric portion guiding said rotary ring element on said balancing drum, said rotary ring element being adapted to axially move under any operating conditions of said pump, and a sealing gasket providing a tight coupling of said cylindric portion and said rotary ring elements.

6. A multiple-stage centrifugal pump, according to claim 1, characterized in that said rotary ring element comprises a first end portion arranged in front of said balancing drum and forming an annular surface, said rotary element further comprising an opposite end portion forming an annular surface.

7. A multiple-stage centrifugal pump, according to claim 3, characterized in that said fixed ring element is mounted on a bottom of said further chamber and forms, with said rotary ring element, a narrowing portion therethrough a radial flow passes.

8. A multiple-stage centrifugal pump, according to claim 1, characterized in that said pump comprises a series of optional spring elements pressing said rotary ring element against said fixed ring element.

* * * * *